US009920273B2

(12) United States Patent
Zhu et al.

(10) Patent No.: US 9,920,273 B2
(45) Date of Patent: Mar. 20, 2018

(54) POLYALKYLENE GLYCOL-GRAFTED POLYCARBOXYLATE SUSPENSION AND DISPERSING AGENT FOR CUTTING FLUIDS AND SLURRIES

(71) Applicant: Dow Global Technologies LLC, Midland, MI (US)

(72) Inventors: Yi-Ping Zhu, Shanghai (CN); Wanglin Yu, Midland, MI (US); Fang Li, Shanghai (CN); Daniel A. Aguilar, Lake Jackson, TX (US); Brad Wurm, Pearland, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/942,178

(22) Filed: Nov. 16, 2015

(65) Prior Publication Data

US 2016/0102265 A1 Apr. 14, 2016

Related U.S. Application Data

(63) Continuation of application No. 13/500,572, filed as application No. PCT/CN2009/001150 on Oct. 16, 2009, now Pat. No. 9,217,118.

(51) Int. Cl.

| | |
|---|---|
| ***C10M 111/04*** | (2006.01) |
| ***C10M 169/04*** | (2006.01) |
| ***C10M 173/02*** | (2006.01) |
| ***B24B 27/06*** | (2006.01) |
| ***B28D 5/04*** | (2006.01) |

(52) U.S. Cl.

CPC ..... *C10M 111/04* (2013.01); *B24B 27/0633* (2013.01); *B28D 5/045* (2013.01); (Continued)

(58) Field of Classification Search

CPC .. B10M 111/04; B24B 27/0633; B28D 5/045; C10M 169/044; C10M 173/02; (Continued)

(56) References Cited

U.S. PATENT DOCUMENTS 3,478,732 A 11/1969 Clark et al.
3,525,324 A 8/1970 Bonnefoy et al.
(Continued)

FOREIGN PATENT DOCUMENTS

EP 1012203 7/2004
JP 3181598 8/1991
(Continued)

OTHER PUBLICATIONS

Machine translation of JP2006111728A.

*Primary Examiner* — Christopher M. Koehler
*Assistant Examiner* — Joel Crandall
(74) *Attorney, Agent, or Firm* — Brooks, Cameron & Huebsch, PLLC

(57) ABSTRACT

Cutting fluids for brittle materials, e.g., silicon ingot, comprise, in weight percent:

A. 70-99% polyalkylene glycol (PAG), e.g., polyethylene glycol;
B. 0.01-10% PAG-grafted polycarboxylate; and
C. 0-30% water.

These cutting fluids are used with abrasive materials, e.g., silicon carbide (SiC), to form cutting slurries. The slurry is sprayed on the cutting tool, e.g., a wire saw, to cut a brittle work piece, e.g., a silicon ingot.

12 Claims, 4 Drawing Sheets

A) Comparison example: containing: conventional polycarboxylate like ACUSOL 445N and PEG B) Comparison example : containing: ACUSOL 425 which is acrylic/maleic acid copolymer and PEG C) Inventive formulation example 1: containing: PEG-grafted polycarboxylate and PEG

(52) U.S. Cl.
CPC ..... *C10M 169/044* (2013.01); *C10M 173/02* (2013.01); *C10M 2201/02* (2013.01); *C10M 2201/061* (2013.01); *C10M 2201/10* (2013.01); *C10M 2209/084* (2013.01); *C10M 2209/086* (2013.01); *C10M 2209/1045* (2013.01); *C10N 2230/02* (2013.01); *C10N 2230/04* (2013.01); *C10N 2240/401* (2013.01)

(58) Field of Classification Search
CPC ..... C10M 2201/02; C10M 2201/061; C10M 2201/10; C10M 2209/084; C10M 2209/086; C10M 2209/1045; C10N 2230/02; C10N 2230/04; C10N 2230/401
See application file for complete search history.

(56) References Cited

U.S. PATENT DOCUMENTS

| | | | | |
|---|---|---|---|---|
| 4,146,488 | A | 3/1979 | Martin | |
| 4,528,334 | A | 7/1985 | Knopf et al. | |
| 5,269,275 | A | 12/1993 | Dahlgren | |
| 5,270,271 | A | 12/1993 | Lundin et al. | |
| 6,020,291 | A | 2/2000 | Lange et al. | |
| 6,673,754 | B1 | 1/2004 | Nabeshima et al. | |
| 2003/0139310 | A1 * | 7/2003 | Smith | C11D 1/72 510/278 |
| 2009/0053976 | A1 | 2/2009 | Roy et al. | |
| 2009/0270293 | A1 | 10/2009 | Ward | |
| 2009/0293369 | A1 | 12/2009 | Gaudet et al. | |
| 2009/0317355 | A1 | 12/2009 | Roth et al. | |

FOREIGN PATENT DOCUMENTS

| | | | |
|---|---|---|---|
| JP | 59147095 | | 8/1994 |
| JP | 2000-198995 | A | 7/2000 |
| JP | 2000229233 | | 8/2000 |
| JP | 2003-082381 | A | 3/2003 |
| JP | 2006-111728 | A | 4/2006 |
| WO | 03042340 | A1 | 5/2003 |

* cited by examiner

A) Comparison example: containing: conventional polycarboxylate like ACUSOL 445N and PEG B) Comparison example : containing: ACUSOL 425 which is acrylic/maleic acid copolymer and PEG C) Inventive formulation example 1: containing: PEG-grafted polycarboxylate and PEG

** PCA: by weight of SiC;
** PCA: 20—30% solid content

** SiC:CF=1:1 ; PCA: by weight of SiC

POLYALKYLENE GLYCOL-GRAFTED POLYCARBOXYLATE SUSPENSION AND DISPERSING AGENT FOR CUTTING FLUIDS AND SLURRIES

FIELD OF THE INVENTION

This invention relates to cutting fluids and slurries. In one aspect the invention relates to cutting fluids for use in suspending and dispersing abrasive particles to form cutting slurries for use in cutting or otherwise treating brittle materials. In another aspect the invention relates to cutting fluids and slurries comprising polyalkylene glycol (PAG) suspension and dispersing agents. In yet another aspect the invention relates to PAG suspension and dispersing agents that are PAG-grafted to a polycarboxylate while in still another aspect, the invention relates to a method of cutting or otherwise treating brittle materials with a cutting slurry comprising a PAG-grafted polycarboxylate.

BACKGROUND OF THE INVENTION

Cutting fluids are used with abrasive materials, e.g., silicon carbide (SiC), to form cutting slurries at a weight ratio typically between 0.5 and 1.5, commonly about 1. This slurry is sprayed on the cutting tool, e.g., a wire saw, to cut a brittle work piece, e.g., a silicon ingot. For optimum performance of the cutting fluid, the abrasive material needs to be evenly suspended and dispersed throughout the fluid, and this requires that the fluid have a certain viscosity to prevent Brownian movement of abrasive materials.

Non-aqueous cutting fluids e.g., those based on a PAG like polyethylene glycol (PEG), are popular in the current market. However, abrasive materials like SiC are not well dispersed in this kind of medium. Wafer producers need to agitate the slurry constantly. On the other hand, good cooling is also required to reduce the thermal stress on the wafer and to avoid swelling of various components of the wire saw apparatus, e.g., the cutting wires, the jig that holds and guides the wafer, etc.

Water has good cooling efficiency and has been tried both as the main dispersing medium of a cutting fluid, and as a component in a cutting fluid blend of water and a PAG. However, the addition of water to a cutting fluid comprising PAG dramatically reduces the viscosity of the fluid and thus not only detracts from the suspension and dispersion properties of the PAG, but also allows for the abrasive materials to settle out of suspension.

The addition of a second dispersing agent can assist in the suspension and dispersion of the abrasive material. U.S. Pat. No. 6,673,754 teaches polycarboxylic acid as such a dispersing agent. The problem, however, is that this kind of conventional polycarboxylic acid has poor compatibility with conventional cutting fluid materials like PEG. Of interest to the manufacturers and users of cutting fluid is a method of improving the suspension and dispersion of abrasive materials in a cutting fluid.

SUMMARY OF THE INVENTION

In one embodiment the invention is a cutting fluid comprising in weight percent:

A. 70-99% PAG;

B. 0.01-10% PAG-grafted polycarboxylate; and

C. 0-30% water.

Water is an optional component of the cutting fluids of this invention. Cutting fluids comprising water generally exhibit better cooling efficiency as compared to cutting fluids alike in all other aspects except without water. Other optional components include, but not limited to, anti-corrosion agents, chelants, wetting agents, pH adjustors and biocides.

In one embodiment the invention is a cutting slurry comprising in weight percent:

A. 25-75%, preferably 28-67%, PAG;

B. 0.004-5%, preferably 0.05-3.35%, PAG-g-polycarboxylate;

C. 0-15%, preferably 0-10%, water; and

D. 25-75%, preferably 33-60%, abrasive material.

The presence of the PAG-g-polycarboxylate in the cutting fluid improves the compatibility of the PAG with the abrasive material relative to a cutting fluid without the PAG-g-polycarboxylate. Moreover, the cutting fluids are suitably viscous so that the Brownian motion of the abrasive particles in the slurries is dampened. This, coupled with the steric and static repulsion imparted to the abrasive particles by the PAG-g-polycarboxylate, improves the suspension and dispersion characteristics of the slurries.

In one embodiment the invention is a method of treating a brittle material, the method comprising the step of applying an abrasive slurry to the brittle material as the brittle material is treated, the abrasive slurry comprising:

A. 25-75%, preferably 28-67%, PAG;

B. 0.004-5%, preferably 0.05-3.35%, PAG-g-polycarboxylate;

C. 0-15%, preferably 0-10%, water; and

D. 25-75%, preferably 33-60%, abrasive material.

The treatment of the brittle material includes but is not limited to cutting, grinding, etching and polishing. The brittle material includes semiconductor ingots and crystals such as those comprising silicon.

DETAILED DESCRIPTION OF THE PREFERRED EMBODIMENT

Figure 1:
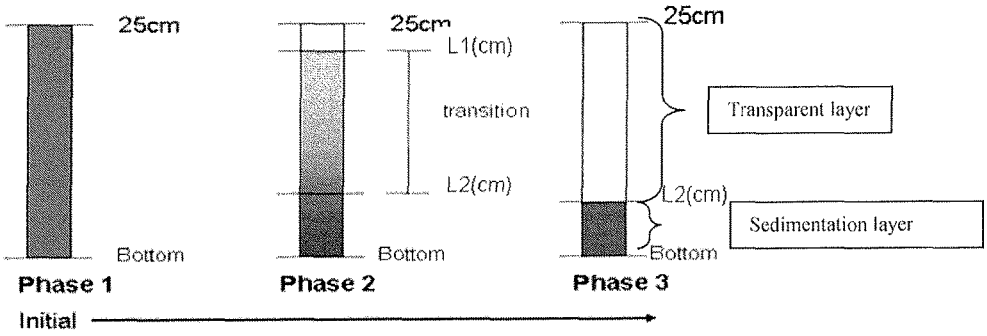
FIG. 1 is a diagram illustrating the measurement of sedimentation in a suspension test.

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of synthetic techniques, definitions (to the extent not inconsistent with any definitions specifically provided in this disclosure), and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the component amounts of the cutting fluids and slurries and various process parameters.

Polyalkylene Glycol (PAG)

The polyalkylene glycols used in the practice of this invention are known compounds, and they are made by the polymerization of an alkylene oxide monomer or a mixture of alkylene oxide monomers initiated by one or more of water and a mono-, di- or polyhydric compound, and promoted by a base catalyst under reactive conditions known in the art (see, for example, "Alkylene Oxides and Their Polymers", Surfactant Science Series, Vol 35). Upon the completion of the polymerization, the reaction mixture is vented and then neutralized by the addition of one or more acids. Optionally, the salts resulting from the neutralization can be removed by any known means. The neutralized polyalkylene glycol product has a pH value of 4.0 to 8.5. For purposes of this invention, "polyalkylene glycol" includes dialkylene glycol, and specifically diethylene glycol.

In one embodiment the initiator is ethylene or propylene glycol or an oligomer of one of them. In one embodiment, the initiator is a compound of the formula $$R^1O—(CHR^2CH_2O)_m—R^3$$

in which $R^1$ and $R^3$ are independently a $C_1$ to $C_{20}$ aliphatic or aromatic group with linear or branched structure and which may contain one or more unsaturated bonds, or hydrogen, with the proviso that at least one of $R^1$ and $R^3$ is hydrogen; each $R^2$ is independently hydrogen, methyl, or ethyl; and m is an integer of 0 to 20. In one embodiment the starter compound is a hydrocarbon compound containing 3 or more hydroxyl groups, such as glycerol or sorbitol.

In one embodiment, the catalyst is a base, typically at least one of an alkali or alkaline earth metal hydroxide or carbonate, aliphatic amine, aromatic amine, or a heterocyclic amine. In one embodiment, sodium or potassium hydroxide is the base catalyst.

The alkylene oxide used as the monomer in the polymerization is a $C_2$ to $C_8$ oxide, such as ethylene oxide, propylene oxide, butylene oxide, hexene oxide, or octene oxide. In one embodiment, the alkylene oxide is ethylene or propylene oxide.

In one embodiment of this invention the polyalkylene oxide is polyethylene oxide, or a water soluble copolymer of ethylene oxide (EO) and propylene oxide (PO), or a mono methyl, ethyl, propyl, or butyl ether of one of them, or a polyethylene oxide or a copolymer of EO and PO initiated by glycerol. In one embodiment, the polyalkylene glycol has a molecular weight of 100-1,000, more typically of 200-600.

Polycarboxylate

The polycarboxylates, also known as polycarboxylic acid-based polymers, used in the practice of this invention are known compounds, and examples include homopolymers or copolymers of acrylic acid, maleic acid or methacrylic acid; or copolymers their various copolymers with ethylene, propylene, styrene, methacrylate ester, maleate monoester, maleate diester, vinyl acetate or the like. In addition, the alkaline metal salts and/or onium salts of these polymeric compounds can be also used. These salts include: salts of a metal ion such as sodium, potassium, lithium and the like; and salts of an onium ion such as ammonia, monoethanolamine, diethanolamine, triethanolamine, methylamine, dimethylamine, trimethylamine, ethylamine, diethylamine, triethylamine, methylethanolamine, dimethylethanolamine, methyldiethanol amine, ethylethanolamine, diethylethanolamine, ethyldiethanolamine and the like. Among these salts, salts of sodium, potassium, ammonia, monoethanolamine and diethanolamine are typical.

Among the polycarboxylic acid-based polymer compounds identified above, particularly suitably used compounds include the alkaline metal salts and/or onium salts of the homopolymer of acrylic acid and/or the copolymer of acrylic acid and maleic acid.

The weight-average molecular weight (Mw) of the polycarboxylic acid-based polymer compound and/or a salt is typically 500-200,000, more typically 1,000-50,000 and even more typically 1,000-10,000.

PAG-g-Polycarboxylates

The PAG-grafted polycarboxylate used in the practice of this invention is a polymeric material comprising a polycarboxylate structure and polyalkylene oxide units that are covalently bonded to the polycarboxylate structure. Possible polycarboxylate structures include a homopolymer or copolymer of acrylic acid, methacrylic acid, maleic acid, styrene sulfonic acid, (meth)allyl sulfonic acid, or 2-acrylamido-2-methypropyl sulfonic acid; or a copolymer further including ethylene, propylene, styrene, methacrylate ester, maleate monoester, maleate diester, vinyl acetate or the like. In addition, the alkaline metal salts and/or onium salts of these polymeric compounds can be also used. These salts include: salts of a metal ion such as sodium, potassium, lithium and the like; and salts of an onium ion such as ammonia, monoethanolamine, diethanolamine, triethanolamine, methylamine, dimethylamine, trimethylamine, ethylamine, diethylamine, triethylamine, methylethanolamine, dimethylethanolamine, methyldiethanolamine, ethylethanolamine, diethylethanolamine, ethyldiethanolamine and the like. Among these salts, salts of sodium, potassium, ammonia, monoethanolamine and diethanolamine are typical.

The PAG unit that is covalently bonded to the aforementioned polycarboxylate structure can be represented by a general formula of $R^1O—(CHR^2CH_2O)_m—$, in which $R^1$ is independently a $C_1$ to $C_{20}$ aliphatic or aromatic group with linear or branched structure and which may contain one or more unsaturated bonds, or hydrogen; each $R^2$ is independently hydrogen, methyl, ethyl, hexyl, or octyl; and m is an integer of 2 to 200, or typically 5 to 100.

The weight percent of total polyalkylene oxide units in PAG-g-polycarboxylate is typically at least 40%, or more typically at least 50, 60, 70, or even more typically higher than 80%.

The PAG unit can be linked with a polycarboxylate structure or carboxylate unit through ether, ester, a C—C bond, amide, or imide. Ether and C—C bond linkages are preferred to provide better hydrolytic stability.

The PAG-g-polycarboxylate can be made by copolymerizing one or more monomers as listed above in preparing polycarboxylates with a polyethylene oxide or copolymer (random or block) of ethylene oxide and propylene oxide that is attached with a carbon-carbon double bond that is radically polymerizable with the unsaturated monomers. Examples of suitable macromers include polyoxyethylene or poly(oxyethylene-oxypropylene) acrylates, methacrylates, maleates, fumarates, and allyl ethers, or the like and mixtures of two or more of these compounds. Suitable macromers preferably have a number average molecular weight in the range of 200 to 10,000, and more preferred 500 to 8,000. Polyoxyethylene or poly(oxyethylene-oxypropylene) allyl ether macromer can be, for example, made by alkoxylation using allyl alcohol as initiator. Polyoxyethylene or poly (oxyethylene-oxypropylene) (meth)acrylate macromers can be produced by reacting a monoalkylether or monoarylether of polyalkylene glycol with (meth)acrylic acid using a known art, or can be produced by alkoxylating a hydroxyl alkyl (meth)acrylate as described in (EP1,012,203). PAG-g-polycarboxylate can also be made by treating a polycarboxylate with a mono alkylether or mono arylether of polyalkylene glycol. In addition, PAG-g-polycarboxylate can also be made by treating a PAG with (meth)acrylic acid, maleic acid, styrene sulfonic acid, (meth)allyl sulfonic acid, or 2-acrylamido-2-methypropyl sulfonic acid under radical polymerization conditions as described in U.S. Pat. No. 4,528,334.

Cutting Fluids

The cutting fluids of this invention comprise a polyalkylene glycol and a PAG-g-polycarboxylate. The amount of polyalkylene glycol in the cutting fluid is typically 70 to 99, more typically 75 to 97 and even more typically 85 to 95 wt %. The amount of PAG-g-polycarboxylate in the cutting fluid is typically 0.01 to 10, more typically 0.05 to 5 and even more typically 0.1 to 3 percent by weight (wt %). Water is optional to the cutting fluid but if present, then it is typically present in an amount of 1 to 30, more typically 5 to 15, wt %.

The cutting fluid may contain other ingredients as well, such as polar solvents (e.g., alcohols, amides, esters, ethers, ketones, glycol ethers or sulfoxides), thickeners (e.g., xanthan gum, rhamsan gum or an alkyl-cellulose such as hydroxymethylcellulose, carboxymethylcellulose), surfactants, biocides, anti-corrosion agents, dyes, fragrances and the like. These other ingredients are used in known manners and in known amounts. The total amount of additives, if present, in the cutting fluid is typically 0.01 to 10, more typically 0.01 to 5 and even more typically 0.01 to 3 percent by weight (wt %).

Cutting Slurries

Ultimately the cutting fluid is mixed with an abrasive material to form a cutting slurry. Abrasive material that can be used in the practice of this embodiment of the invention include diamond, silica, tungsten carbide, silicon carbide, boron carbide, silicon nitride, aluminum oxide or other hard grit powder or similar material. One of the most preferred abrasive materials is silicon carbide. Generally, mean or average particle sizes range from about 2-50 microns; and preferably from 5-30 microns, depending on the international grade designations of the grit powder. The concentrations of the abrasive material in the cutting slurry typically range from 20 to 70, more typically from 25 to 60 and even more typically from 35-60, wt %.

The cutting slurry is used in a known matter. Typically it is sprayed upon a cutting wire as a workpiece is brought into contact with the cutting wire. The cutting wire is part of a cutting apparatus commonly known as a wiresaw or wire-web, and it usually comprises a row of fine wires arranged parallel to each other and at a fixed pitch. A workpiece is pressed against these fine wires (which typically have a diameter of 0.1-0.2 millimeters (mm) running in parallel with one another in the same direction, while a cutting slurry is supplied between the workpiece and the wires, the workpiece sliced into wafers by an abrasive grinding action. The liquid suspended abrasive particles are coated onto the moving web or wire through a circulation system which drops a blanket-curtain of the cutting slurry onto the web just before the wire-web impacts the workpiece. Thus, the abrasive particles carried by the liquid are transferred by the coated wires to produce a grinding or cutting effect. These wiresaws are described more fully in U.S. Pat. No. 3,478,732, U.S. Pat. No. 3,525,324, U.S. Pat. No. 5,269,275 and U.S. Pat. No. 5,270,271.

The cutting slurries of this invention can be used in other treatments of a hard, brittle material, such as an ingot, crystal or wafer of silicon, gallium arsenide (GaAs) or gallium phosphide (GaP). These other treatments include without limitation grinding, etching and polishing.

The following examples are illustrative of certain embodiments of the present invention. All parts and percentages are based on weight except as otherwise indicated.

Specific Embodiments

Chemicals and Equipment

Table 1 reports the chemicals and equipment used to make the cutting fluids and slurries of the following examples.

TABLE 1

Chemicals and Equipment

| Chemicals and Equipments | Ingredients | Sources |
|---|---|---|
| Dispersing Agent | PAG-g-Polycarboxylate (Mw 20000-30000) Solid Content (20 wt %) | — |
| | ACUSOL 445N (About 5000 Mw) Polyacrylic acid homopolymer | R&H |
| | ACUSOL 425 (About 2000 Mw); Acrylic/maleic acid copolymer | R&H |
| SiC | SiC # 1200 | Omex |
| Water | Pure water | Dow |
| PEG | CARBOWAX ™ PEG200 | Dow |
| HCl | 37 wt % | Guo Yao |
| NaOH | 8 wt % | Guo Yao |
| Mix Mixer | RW20 | IKA |
| Mixer | Magnetic mixer | IKA |
| pH meter | Seven Multi | Mettler Toledo |
| Viscosity meter | DV-II | Brookfield |

Testing Methods

Compatibility Test

Mix 10 milliliters (ml) PEG-200 with 5 wt % (by weight of PEG-200) and other additives, if any. Agitate the mixture well (at least five minutes with a magnetic mixer at middle speed (approximately 400 rpm)). Allow to stand at 21° C. (lab temperature) for one hour, and then inspect the appearance of mixture.

Suspension Test

Prepare 25 ml cutting fluids as shown in Table 3. Agitate the mixture well (at least five minutes with a magnetic mixer at middle speed (approximately 400 rpm)). Add SiC particles into the cutting fluid at a weight ratio of 9:1 (cutting fluid to SiC). Agitate the slurry with IKA RW20 mixer at 400 rpm for 10 min. Pour 25 ml of slurry into a graduated flask (capacity of 25 ml) slowly (avoid the stain of slurry on the wall of the flask). Allow to stand at 21° C. (lab temperature), and record the height of transparent, transition and sedimentation layers as shown in FIG. 1. Scale L1 and L2 are recorded after 2, 4 and 6 hours separately. The height (25-L2) (cm) is used to measure the suspension stability, the shorter the better.

Viscosity

Prepare 250 ml slurry in the same manner as described for the suspension test. The ratio of cutting fluid to SiC is 1:1 (w/w). Measure the viscosity of the prepared slurry with a Brookfield DV meter (Spindle #62) at 21° C. (lab temperature).

pH Adjustment

Add sodium hydroxide (NaOH) or hydrochloric acid (HCl) slowly into a slurry prepared as described for the suspension test while monitoring with a pH meter.

Test Results

Compatibility Test Results

Figure 2:
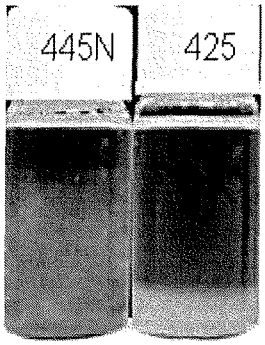
FIG. 2 is a collection of photographs comparing the compatibility of PAG-g-polycarboxylate and conventional polycarboxylates with polyethylene glycols (PEG).
Figure 2:
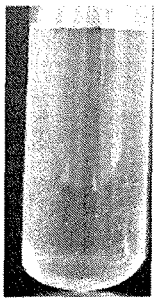

The compatibility test results are reported in Table 2 and illustrated in the photographs of FIG. 2.

TABLE 2

Compatibility Test Results

| Polycarboxylate | Appearance |
|---|---|
| ACUSOL 445N | Turbid |
| ACUSOL 425 | Turbid, sedimentation |
| PAG-g-Polycarboxylate | Transparent |

Conventional polycarboxylate like ACUSOL 445N is a polyacrylic acid homopolymer. The appearance of this sample is turbid which is indicative of poor compatibility of ACUSOL 445N with PEG. ACUSOL 425 is an acrylic/maleic acid copolymer. The appearance of this sample is also turbid and this too means that the compatibility of ACUSOL 425 with PEG is poor. The PAG-g-polycarboxylate is PEG-g-polycarboxylate. The appearance of this sample is transparent which means that the compatibility of PEG-g-polycarboxylate with PEG is good (due to the ethylene oxide chain of the polycarboxylate).

Sedimentation Test Results

Figure 3:
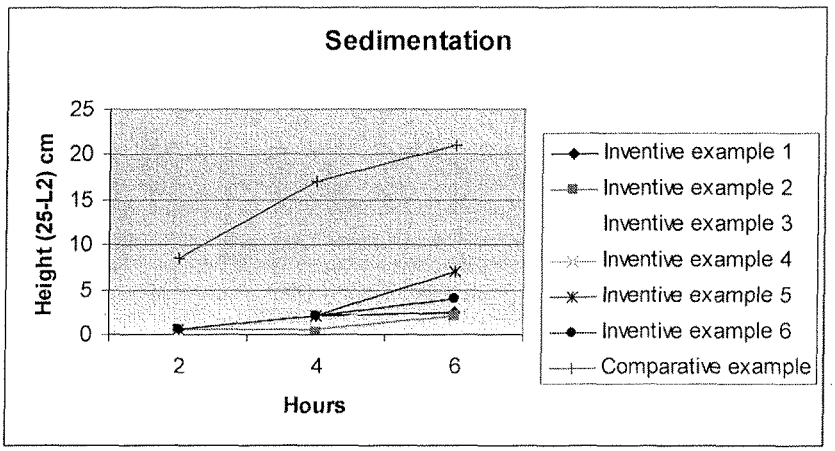
FIG. 3 is a graph reporting the suspension and dispersion properties of various inventive and comparative cutting fluids.

Table 3 reports the formulations used in the sedimentation tests, and Table 4 and FIG. 3 report the results.

TABLE 3

Cutting Fluid Formulations

| Example No. | PEG-200 (wt %) | Dispersing agent-PAG-g-Polycarboxylate (wt % by weight of SiC) | Water (wt %) |
|---|---|---|---|
| 1 | 100 | 1 | 0 |
| 2 | 100 | 3 | 0 |
| 3 | 95 | 1 | 5 |

TABLE 3-continued

Cutting Fluid Formulations

| Example No. | PEG-200 (wt %) | Dispersing agent-PAG-g-Polycarboxylate (wt % by weight of SiC) | Water (wt %) |
|---|---|---|---|
| 4 | 90 | 1 | 10 |
| 5 | 85 | 1 | 15 |
| 6 | 90 | 3 | 10 |
| C-1 | 100 | 0 | 0 |

TABLE 4

Sedimentation Test Results

| Example No. | Sedimentation Height (cm) 2 (hr) | 4 (hr) | 6 (hr) |
|---|---|---|---|
| 1 | 0.5 | 2 | 2.5 |
| 2 | 0.5 | 0.5 | 2 |
| 3 | 0.5 | 1.5 | 4 |
| 4 | 0.5 | 1.5 | 4 |
| 5 | 0.5 | 2 | 7 |
| 6 | 0.5 | 2 | 4 |
| C-1 | 8.5 | 17 | 21 |

The results show that the inventive examples have much better suspension/dispersion properties than the comparative example (PEG-200) which is widely used in the current market as a cutting fluid. All of the reported inventive formulations in Table 3 have much better performance which shows that the PEG-g-polycarboxylate and its derivatives have good performance at concentrations of 1 and 3 wt % of the abrasive material, here SiC.

Viscosity Test Results

Figure 4:
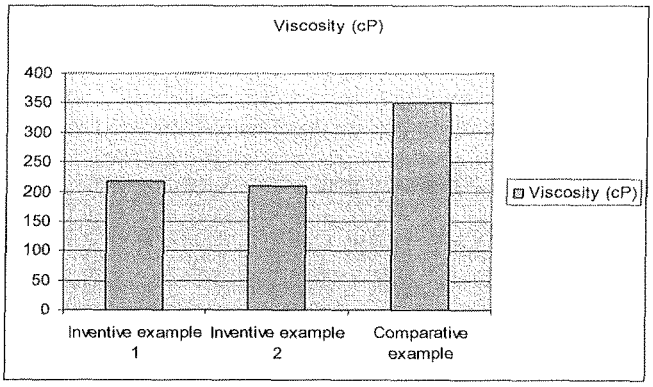
FIG. 4 is a chart reporting the viscosity of various inventive and comparative cutting fluids.

Table 5 and FIG. 4 report the results of the viscosity tests on Examples 1 and 2 and Comparative Example 1. The slurry comprises cutting fluid and SiC at a 1:1 weight ratio.

TABLE 5

Viscosity Test Results

| Examples | Viscosity (cP) |
|---|---|
| 1 | 216.9 |
| 2 | 209.7 |
| C-1 | 350.9 |

The results show that the inventive examples have a much lower viscosity than the comparative example. From a rheology perspective, at higher concentration conditions (such as higher solid content of SiC), the viscosity can be used to measure the dispersion of solid particles in PEG. Low viscosity suggests good dispersion.

pH Test Results

Figure 5:
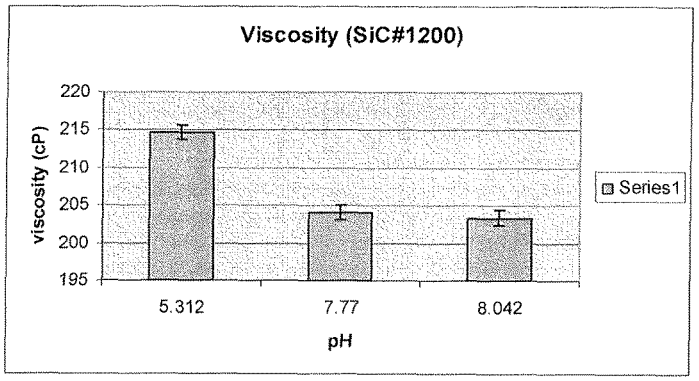
FIG. 5 is a chart reporting the effect of pH adjustments on the viscosity of an inventive cutting fluid.
Figure 6:
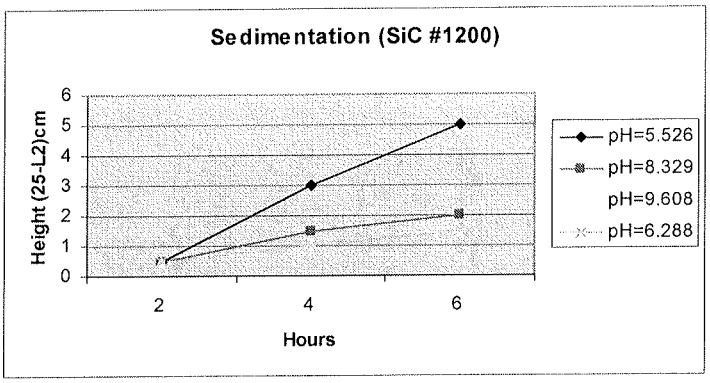
FIG. 6 is a graph reporting the effect of pH adjustments on the sedimentation of silicon carbide particles from an inventive dispersing agent.

FIGS. 5 and 6 report the effects of pH on viscosity and sedimentation for the formulations of Examples 2 and 6. A higher pH results in a lower viscosity which means better dispersion. A high pH also results in a less sedimentation which means better suspension. Formulations with a pH of 5-7 are preferred and with a pH of 7-8 more preferred.

Carrying Capacity

Figure 7:
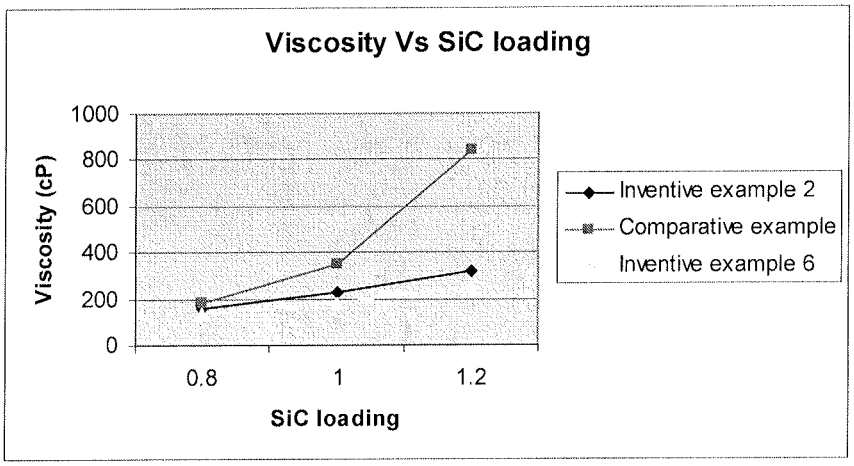
FIG. 7 is a graph reporting the carrying capacity of an inventive cutting fluid.
Figure 8:
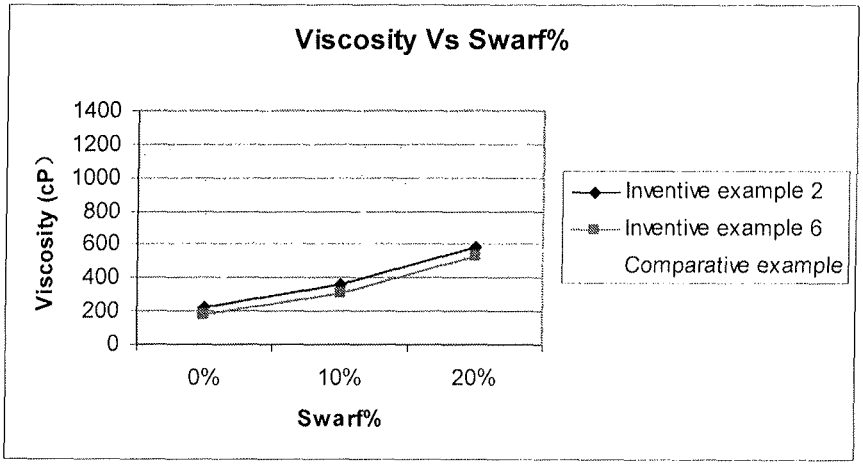
FIG. 8 is a graph reporting the viscosity versus swarf content of various inventive and comparative cutting fluids.

FIGS. 7 and 8 show that an increase in the loading of SiC and swarf has less impact on the viscosity of the formulations of this invention than on the formulation of the comparative example. This, in turn, means that the inventive formulations have a higher carrying capacity than that of the comparative example. In FIG. 7 the amount of dispersing agent in the examples is based on the weight of the SiC. In FIG. 8 the SiC and cutting fluid are present at a 1 to 1 weight ratio, and the dispersing agent is present in weight percent of SiC.

Viscosity v. Temperature

Figure 9:
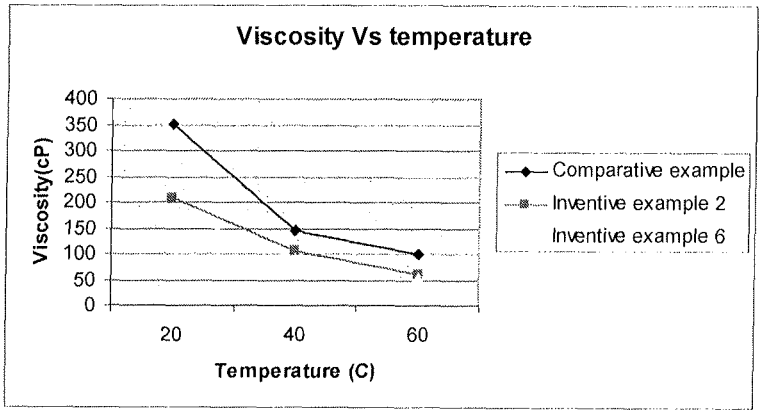
FIG. 9 is a graph reporting the viscosity versus temperature of various inventive and comparative cutting fluids.

FIG. 9 shows that the change in viscosity experienced by the inventive formulations as a result of an increase in temperature is smaller than that seen with a comparative cutting slurry under similar conditions. The inventive formulations also show better stability than the comparative formulation. In FIG. 9 the SiC and cutting fluid are present at a 1 to 1 weight ratio, and the dispersing agent is present in weight percent of SiC.

Although the invention has been described with certain detail through the preceding specific embodiments, this detail is for the primary purpose of illustration. Many variations and modifications can be made by one skilled in the art without departing from the spirit and scope of the invention as described in the following claims.

What is claimed is:

1. A cutting slurry comprising in weight percent:

A. 25-90% PAG having a molecular weight of 100-1,000;

B. 0.004-5% PAG-g-polycarboxylate comprising a polycarboxylate structure and polyalkylene oxide units covalently bonded to the polycarboxylate structure, wherein the polycarboxylate structure comprises units derived from acrylic acid, maleic acid or methacrylicacid and the weight percent of total polyalkylene oxide units in the PAG-g-polycarboxylate is at least 40%;

C. 0-15% water; and

D. 25-75% abrasive material, wherein the abrasive material includes diamond, silica, tungsten carbide, silicon carbide, boron carbide, silicon nitride, aluminum oxide or combinations thereof.

2. The cutting slurry of claim 1 in which the polycarboxylate structure has a molecular weight of 1,000 to 10,000.

3. The cutting slurry of claim 2 in which the weight percent of total polyalkylene oxide units in the PAG-g-polycarboxylate is at least 60%.

4. The cutting slurry of claim 3 wherein the cutting slurry has a pH of 5-8.

5. The cutting slurry of claim 4 further comprising wherein the weight percent of the PAG is 25-67%, wherein the weigh percent of the PAG g-polycarboxylate is 0.004-5%, wherein the weight percent of the water is 0-15%, and wherein the weight percent of the abrasive material is 25-70%.

6. The cutting slurry of claim 1, wherein the weight percent of the PAG is 25-75%.

7. The cutting slurry of claim 1, wherein the weight percent of the PAG is 70-90%.

8. A method of cutting a brittle material with a cutting wire, the method comprising the step of applying abrasive slurry to the wire as the brittle material is brought into contact with the wire, the abrasive slurry comprising:

A. 25-75% PAG having a molecular weight of 100-1,000;

B. 0.004-5% PAG-g-polycarboxylate comprising a polycarboxylate structure and polyalkylene oxide units covalently bonded to the polycarboxylate structure, wherein the polycarboxylate structure comprises units derived from acrylic acid, maleic acid or methacrylic acid and the weight percent of total polyalkylene oxide units in the PAG-g-polycarboxylate is at least 40%;

C. 0-15% water; and

D. 25-75% abrasive material.

9. The method of claim 8 in which the polycarboxylate structure has a molecular weight of 1,000-10,000.

10. The method of claim 9 in which the weight percent of total polyalkylene oxide units in the PAG-g-polycarboxylate is at least 60%.

11. The method of claim 10 wherein the abrasive slurry has a pH of 5-8.

12. The method of claim 10 wherein the abrasive slurry has a PH of 7-8.

* * * * *